US009927093B2

(12) United States Patent
Peng et al.

(10) Patent No.: US 9,927,093 B2
(45) Date of Patent: Mar. 27, 2018

(54) LIGHT REFLECTING MODULE WITH MULTIPLE REFLECTIVE SHEETS

(71) Applicant: Taiwan Network Computer & Electronic Co., Ltd., New Taipei (TW)

(72) Inventors: Chia-Mei Peng, Ping-Chen (TW); Hsieh-Chen Chuang, New Taipei (TW); Ping-Han Chuang, New Taipei (TW)

(73) Assignee: TAIWAN NETWORK COMPUTER & ELECTRONIC CO., LTD., New Taipei (TW)

( * ) Notice: Subject to any disclaimer, the term of this patent is extended or adjusted under 35 U.S.C. 154(b) by 64 days.

(21) Appl. No.: 15/220,654

(22) Filed: Jul. 27, 2016

(65) Prior Publication Data

US 2017/0059125 A1 Mar. 2, 2017

(30) Foreign Application Priority Data

Aug. 24, 2015 (CN) ..... 2015 2 0640883 U

(51) Int. Cl.

| | |
|---|---|
| ***F21V 7/04*** | (2006.01) |
| ***F21V 7/10*** | (2006.01) |
| ***F21V 7/09*** | (2006.01) |
| ***F21S 8/10*** | (2006.01) |

(52) U.S. Cl.

CPC ..... *F21V 7/04* (2013.01); *F21S 48/1305* (2013.01); *F21S 48/137* (2013.01); *F21S 48/232* (2013.01); *F21S 48/234* (2013.01); *F21V 7/09* (2013.01); *F21V 7/10* (2013.01)

(58) Field of Classification Search

CPC .... F21V 7/0083; F21V 7/0033; F21V 7/0041; F21V 7/04; F21V 7/10; F21V 7/09; F21V 7/0025; F21S 48/234; F21S 48/232; F21S 48/137; F21S 48/1305

See application file for complete search history.

(56) References Cited

U.S. PATENT DOCUMENTS

| | | | | |
|---|---|---|---|---|
| 2012/0098404 | A1* | 4/2012 | Kaandorp | F21V 14/04 313/114 |
| 2013/0135875 | A1* | 5/2013 | Schutte | F21V 7/0025 362/297 |
| 2016/0129766 | A1* | 5/2016 | Lenterman | B60J 1/2091 160/370.23 |
| 2017/0038096 | A1* | 2/2017 | Hilliard | F24J 2/055 |

* cited by examiner

*Primary Examiner* — Joseph L Williams
*Assistant Examiner* — Jose M Diaz
(74) *Attorney, Agent, or Firm* — Guice Patents PLLC

(57) ABSTRACT

A light reflecting module includes a securing ring comprising a tube having an outer surface and an inner surface, at least one non-circular plane extending outwards from the outer surface at one end of the tube and an annular plane extending toward a center of the tube and comprising a top plane and a bottom plane, the annular plane has at least one through hole; and a plurality of reflective sheets, wherein each of the reflective sheets includes an inner surface which is a curved surface and serves as a reflecting surface, and the width of the reflective sheet is gradually decreased from a bottom surface to a top surface of the reflective sheet.

10 Claims, 10 Drawing Sheets

LIGHT REFLECTING MODULE WITH MULTIPLE REFLECTIVE SHEETS

BACKGROUND OF THE INVENTION

Field of the Invention

The invention relates to a light reflecting module including multiple reflective sheets, and more particularly to a light reflecting module suitable for improvement and upgrade of brightness of a vehicle lamp without disassembly procedure.

Description of the Related Art

Referring to FIG. 1A, a lamp A01 includes a protective cover 101, a transparent plate 102 and a reflector 103. A positioning member 104 with through holes is disposed behind the protective cover 101 and the reflector 103 for a light source 105 mounted thereon.

Referring to FIGS. 1B and 1C, a reflector 106 of higher reflection efficiency is disposed within the original reflector for brightness improvement. As shown in FIG. 1C, a light emitting module 107 is equipped with a LED light source or a xenon lamp for brightness upgrade. Either improvement or upgrade for lamp brightness, the cover 101 which is sealed for water proof and the transparent plate 102 must be detached for mounting the reflector 106 or the light source in the reflector 103, and the cover 101 is mounted to the lamp, which increases labor for improvement or upgrade of the lamp brightness. The lamp may have leakage problem if the cover 101 is not well sealed.

BRIEF SUMMARY OF THE INVENTION

An object of the invention is to provide a light reflecting module with multiple reflective sheets and can be easily assembled to a lamp for brightness improvement and upgrade without detaching the lamp.

The invention provides a light reflecting module. The light reflecting module in accordance with an exemplary embodiment of the invention includes a securing ring comprising a tube having an outer surface and an inner surface, at least one non-circular plane extending outwards from the outer surface at one end of the tube and an annular plane extending toward a center of the tube and comprising a top plane and a bottom plane, the annular plane has at least one through hole; and a plurality of reflective sheets, wherein each of the reflective sheets includes an inner surface which is a curved surface and serves as a reflecting surface, and the width of the reflective sheet is gradually decreased from a bottom surface to a top surface of the reflective sheets.

In another exemplary embodiment, each of the reflective sheets includes a hole on the top surface.

In yet another exemplary embodiment, the reflective sheet further includes a groove on the top surface and an L-shaped protrusion protruding from the top surface, the L-shaped protrusion having at least one through hole.

In another exemplary embodiment, each of the reflective sheets further includes a positioning element protruding from an end surface of at least one lateral side of the reflective sheet.

In yet another exemplary embodiment, each of the reflective sheets further includes a positioning element disposed on an outer surface of a lateral side of the reflective sheet and not exceeding the lateral side, and at least one magnet is disposed on the positioning element.

In another exemplary embodiment, the positioning element on the top surface is a hole in which a magnet is disposed.

In yet another exemplary embodiment, the positioning element includes a groove and an L-shaped protrusion protruding from the top surface and having at least one through hole.

In another exemplary embodiment, the positioning element on the top surface includes a hole and an L-shaped protrusion extending from a lateral surface adjacent to a top of the reflective sheet.

In yet another exemplary embodiment, each of the reflective sheets further includes a positioning element extending outwards from an outer surface of at least one lateral side of the reflective sheet and a magnet disposed on the projecting positioning element.

In another exemplary embodiment, each of the reflective sheets further includes a projecting positioning element protruding from an outer surface of at least one lateral side of the reflective sheet.

In yet another exemplary embodiment, each of the reflective sheets further includes a projecting positioning element and at least one groove on an outer surface of the reflective sheet, and a light emitting diode is disposed in the groove.

In another exemplary embodiment, each of the reflective sheets further includes a hole formed on one lateral side of the reflective sheet and a projecting positioning element disposed on another lateral side of the reflective sheet and corresponding to the hole.

In yet another exemplary embodiment, the tube includes at least one notch.

In another exemplary embodiment, the tube includes at least one notch and a spring sheet protruding from the notch.

In yet another exemplary embodiment, at least two of the reflective sheets have different curved surfaces.

In another exemplary embodiment, at least two reflective sheets have different sizes.

In yet another exemplary embodiment, at least two of the reflective sheets has different curved surfaces and at least two reflective sheets have different sizes.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figures 1A, 1B, 1C:
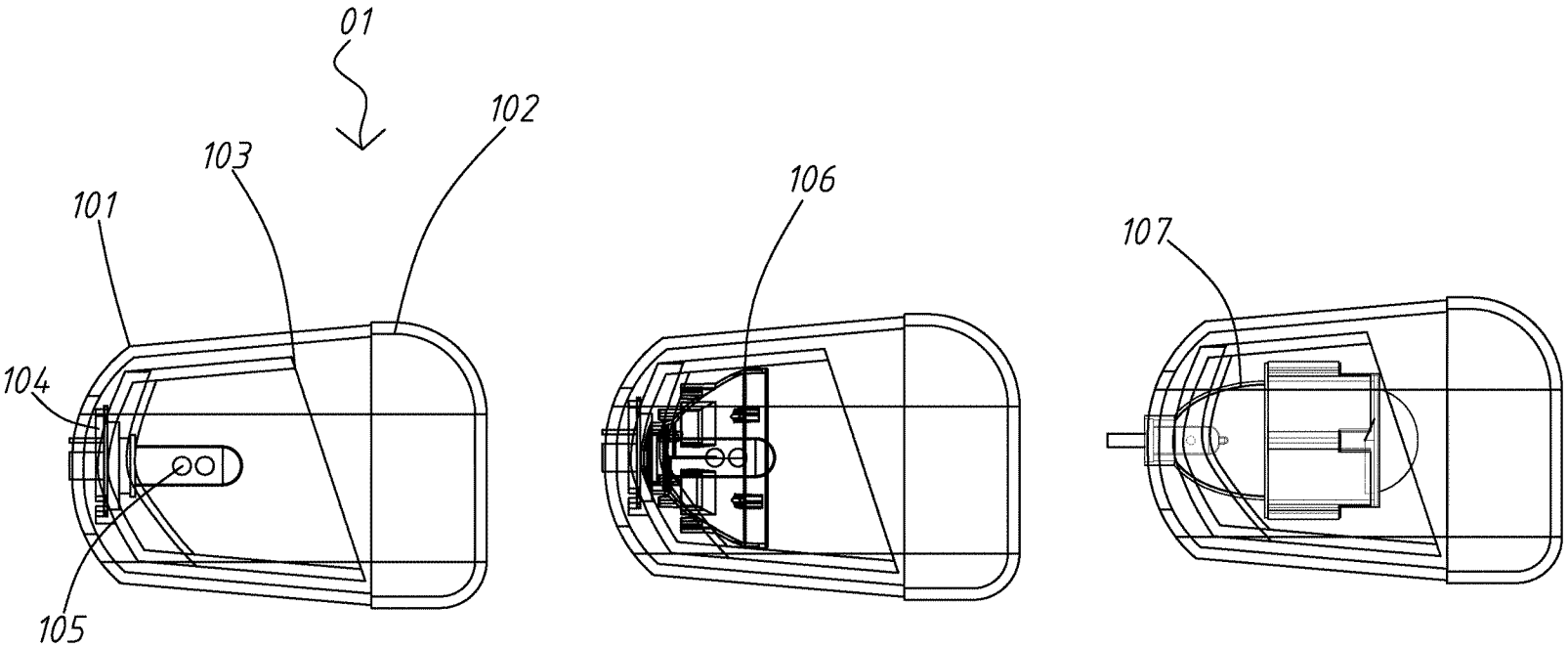
FIG. 1A PRIOR ART
FIG. 1B PRIOR ART
FIG. 1C PRIOR ART
FIG. 1A is a side view of a conventional vehicle lamp.
FIG. 1B is cross-sectional view of a conventional vehicle lamp with a second reflector.
FIG. 1C is a cross-sectional view of a conventional vehicle lamp with a light emitting module.
Figures 2A, 2B, 2C:
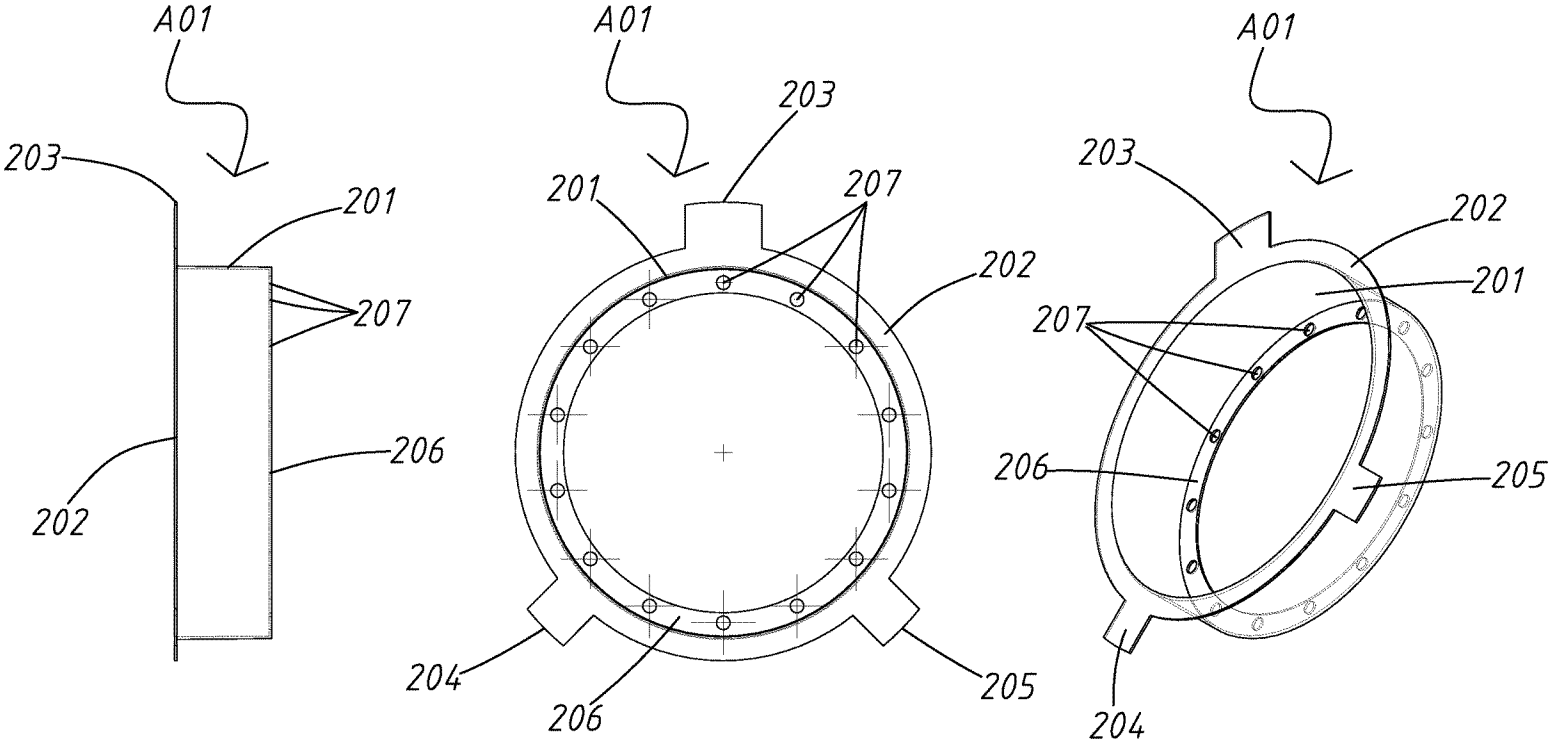
FIGS. 2A to 2C depict a first embodiment of a securing ring of the invention.

Referring to FIGS. 2A to 2C, a securing ring A01 includes a tube 201 having an outer surface, an inner surface, a curved plane 202 and three squared plans 203, 204 and 205. The tube 201 is preferably circular and has a non-circular plane extending outwards from one end thereof. The non-circular plane includes the curved plane 202 and the squared plans 203, 204 and 205 extending from the outer surface at one end of the tube 201 and are used for directional positioning. In another embodiment, the non-circular plane includes a curved plane and a squared plane. The tube 201 further includes an annular plane 206 extending from the inner surface toward a center of the tube 201 at the other end and a plurality of through holes 207. The annular plane can be disposed in any position between two ends of the tube 201.

Figure 3C:
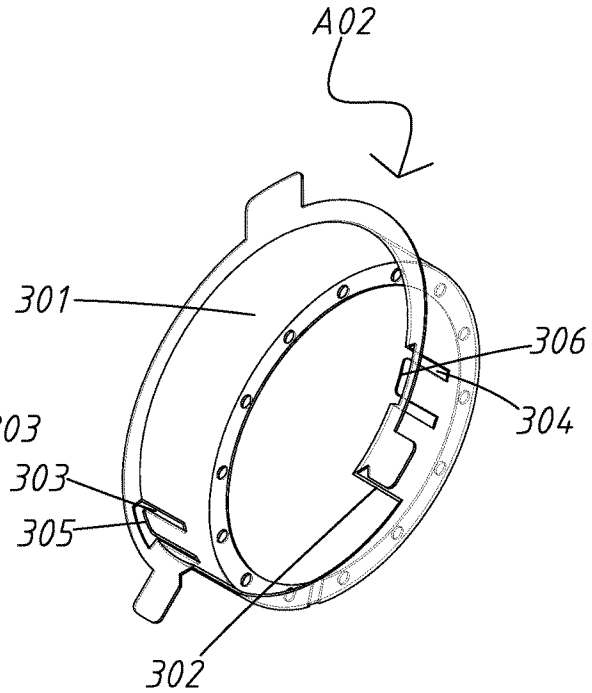
FIGS. 3A to 3C depict a second embodiment of a securing ring of the invention.
Figure 3B:
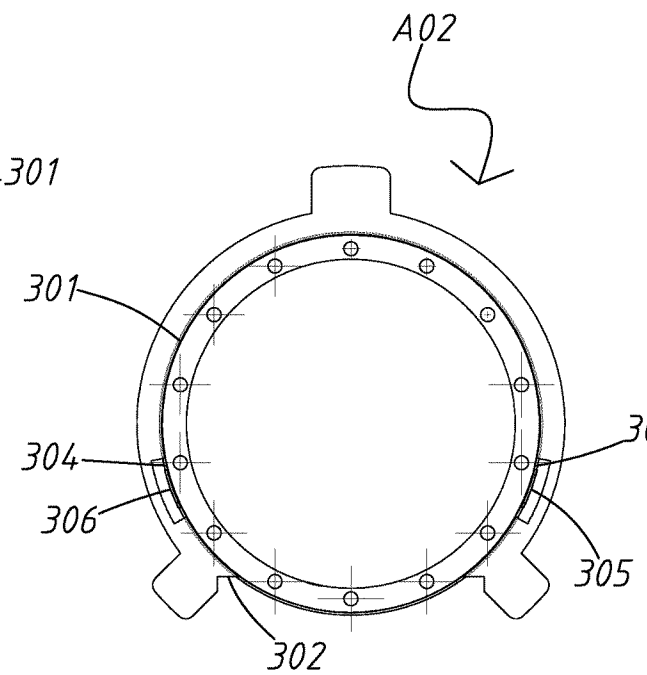
Figure 3A:
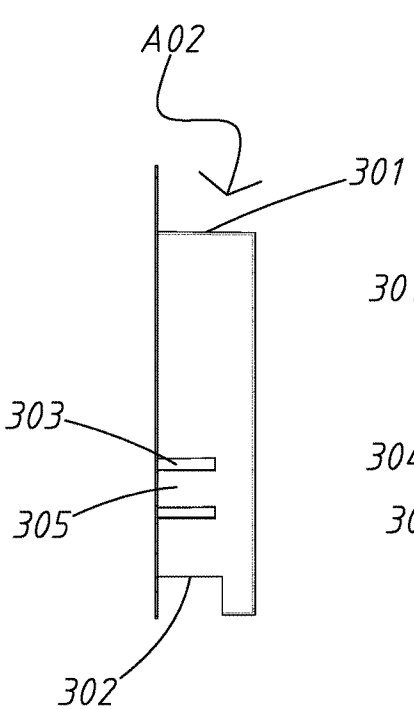

Referring to FIGS. 3A to 3C, a securing ring A02 has a structure similar to the structure of the securing ring A01 of FIGS. 2A to 2C. The tube 301 further includes a notch 302 preventing interference with bulb seat of a lamp of a vehicle. In another embodiment, the tube 301 further includes two notches 303 and 304 to form two spring sheets 305 and 306.

Figures 4A, 4B, 4C:
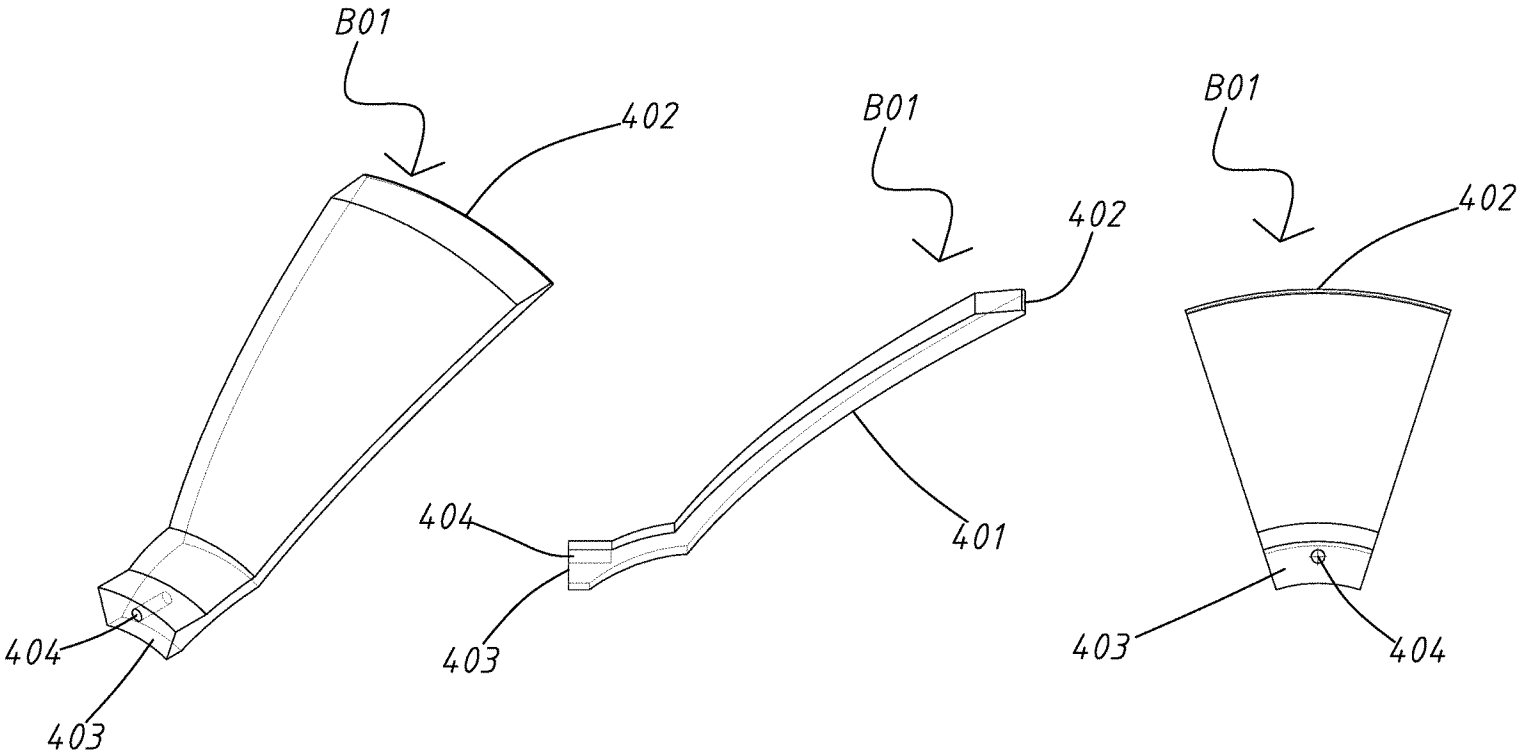
FIGS. 4A to 4C depict a first embodiment of a reflective sheet of the invention.

Referring to FIGS. 4A to 4C, a reflective sheet B01 is a curved surface and serves as a reflecting surface 401. The reflective sheet B01 has a top surface 403 and a bottom surface 402, and the width of the reflective sheet B01 gradually decreases from the bottom surface 402 to the top surface 403. The reduction of the width depends upon the size of the tube joined to the securing ring. The larger is the size of the tube, the reduction of width is smaller. A positioning element 404 is disposed on the top surface 403 which is a hole or a groove. In this embodiment, the positioning element 504 is a hole for insertion of a bolt or a magnet.

Figure 5C:
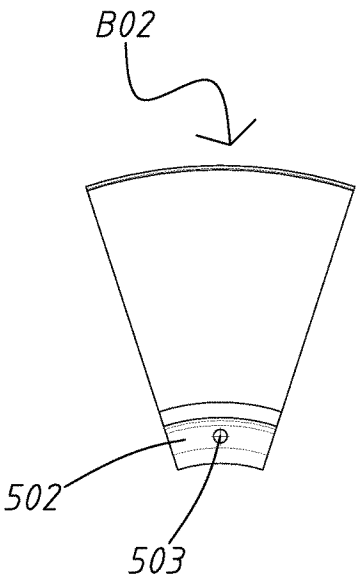
FIGS. 5A to 5C depict a second embodiment of a reflective sheet of the invention.
Figure 5B:
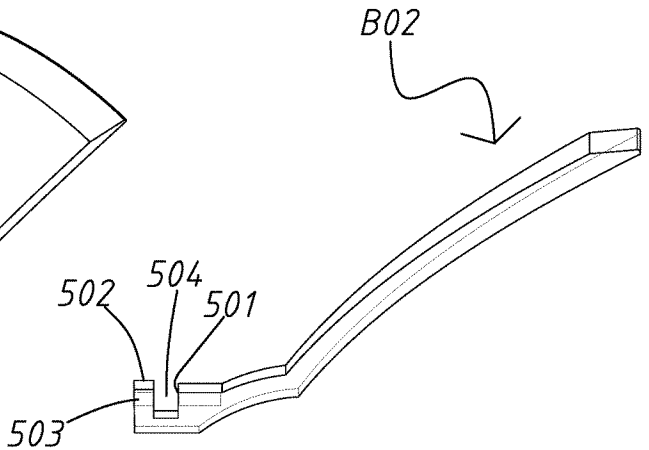
Figure 5A:
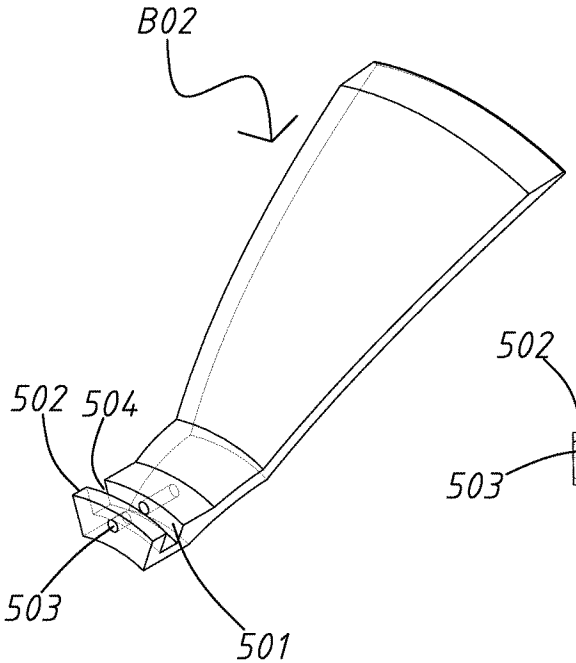

Referring to FIGS. 5A to 5C, the reflective sheet B02 has a structure similar to the reflective sheet B01 of FIGS. 4A to 4C. However, the reflective sheet B02 includes a L-shaped protrusion 502 extending from the top surface 501 and having a through hole 503. The L-shaped protrusion 502 and the top surface 501 form a groove 504 which is joined to the annular plane of the securing ring tightly.

Figure 6C:
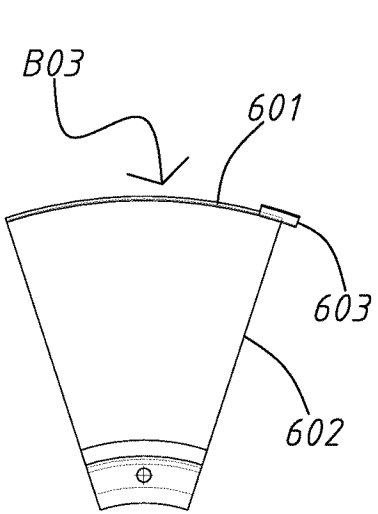
FIGS. 6A to 6C depict a third embodiment of a reflective sheet of the invention.
Figure 6B:
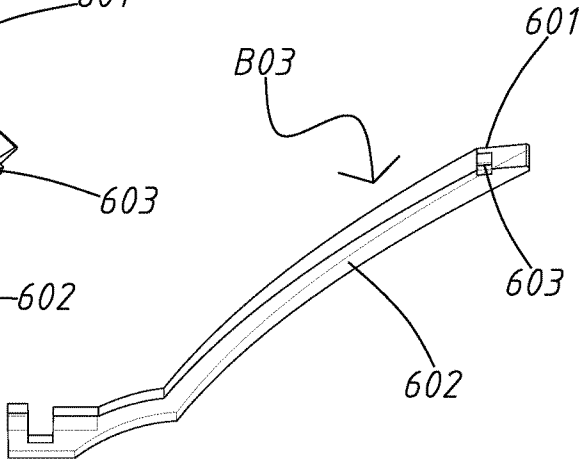
Figure 6A:
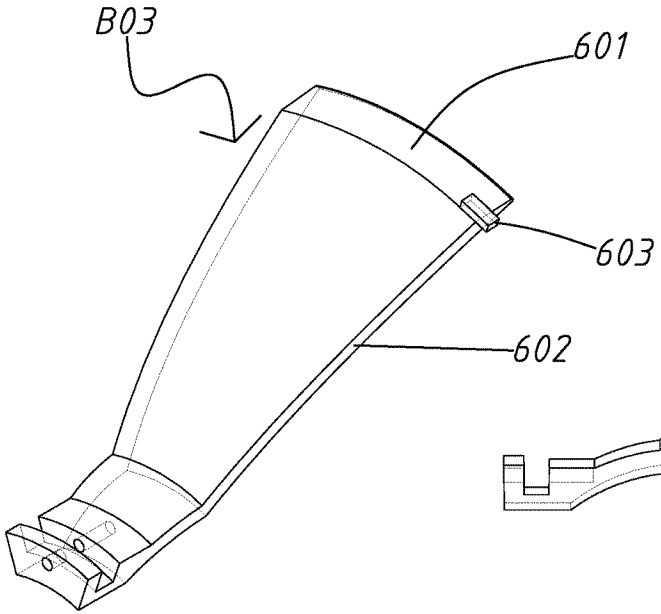

Referring to FIGS. 6A and 6C, a reflective sheet B03 has a structure similar to the structure of the reflective sheet B02 of FIGS. 5A to 5C. However, the reflective sheet B03 includes a positioning element 603 disposed on an outer surface 601 adjacent to a lateral surface 602 and protruding above the lateral surface 602. Therefore, when two reflective sheets B03 are joined, the reflective sheets B03 are not in the same plane through the described structure.

Figure 7B:
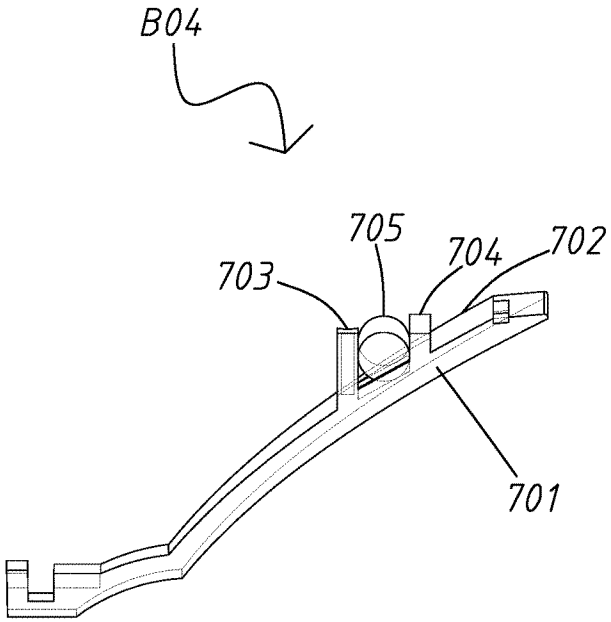
FIGS. 7A to 7B depict a fourth embodiment of a reflective sheet of the invention.
Figure 7A:
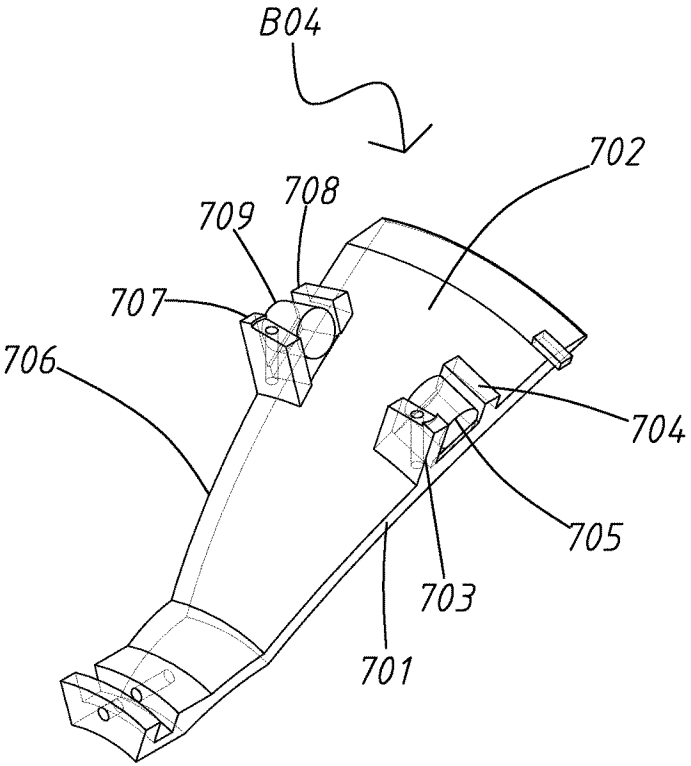

Referring to FIGS. 7A and 7B, a reflective sheet B04 has a structure similar to the structure of reflective sheet B03 of FIGS. 6A and 6B. However, the reflective sheet B04 further includes two positioning elements 703 and 704 disposed on an outer surface 702 of a lateral side 701 and not exceeding the lateral side 701. A magnet 705 is secured by the positioning elements 703 and 704. Another two positioning elements 707 and 708 are disposed on the outer surface of another lateral side 706 and not exceeding the lateral side 706. A magnet 709 is secured by the positioning elements 707 and 708. Two reflective sheets are joined by the magnets in this embodiment.

Figures 8A, 8B, 8C, 8D:
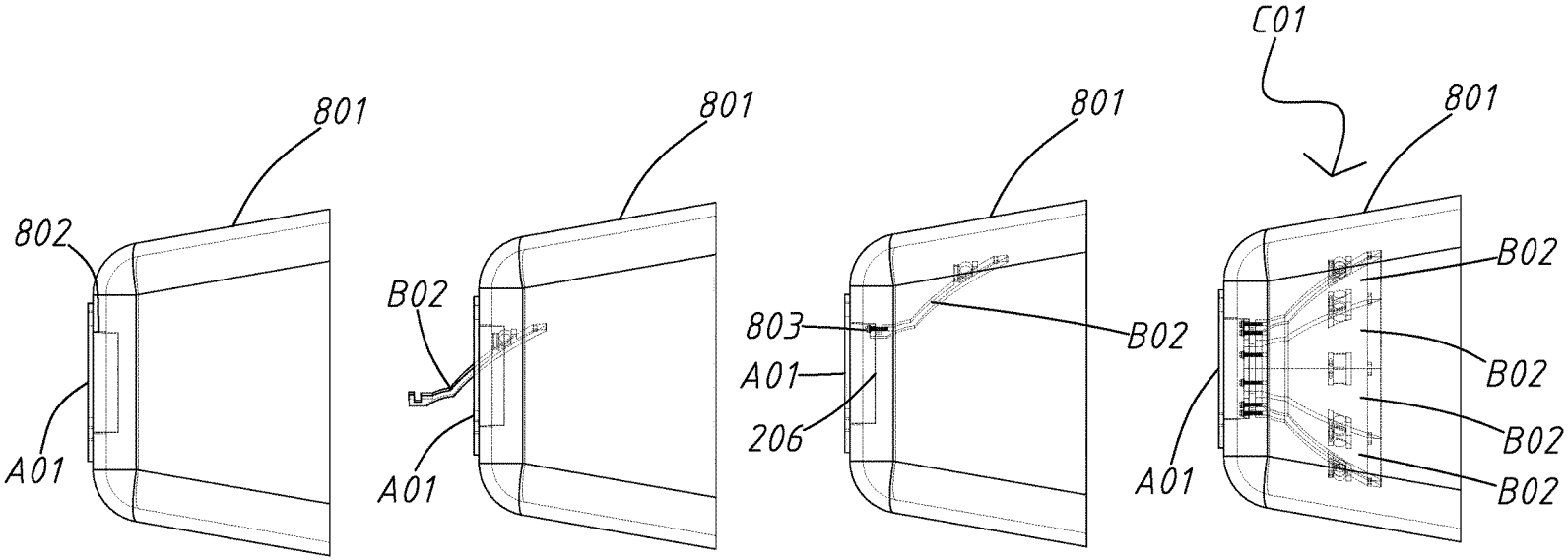
FIGS. 8A to 8D depict a first embodiment of a light emitting module of the invention.

Referring to FIGS. 8A to 8D, an embodiment of a lamp for vehicles having a light reflecting module is disclosed. FIG. 8A shows the securing ring A01 disposed a through hole 802 of a reflector 801. FIG. 8B shows the reflective sheet B02 is moved to an interior of the reflector 801 through a middle through hole of the securing ring A01. FIG. 8C shows the reflective sheet B02 is secured to the securing ring A01 through a groove on a top of the reflective sheet B02 engaging an annular plane 206 on an inner surface of the securing ring A01 and a bolt 803 joining the reflective sheet B02 and the securing ring A01. FIG. 8D shows a light reflecting module C01 including a plurality of reflective sheets B02 and a securing ring A01. The light reflecting module C01 is configured to be mounted in the reflector 801 to reflecting most light beams. In FIGS. 8A to 8D, each of the reflective sheets has identical curved surface and the same size, and the reflective sheets constitutes a circular reflector. In another embodiment, the reflective sheets have different curved surface and different sizes to constitute a circular or non-circular light reflecting module.

Figure 9D:
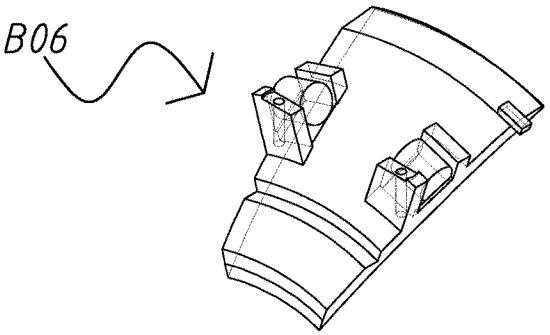
FIGS. 9C to 9D depict a sixth embodiment of a securing ring of the invention.
Figure 9C:
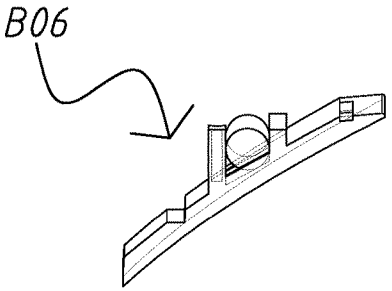
Figure 9B:
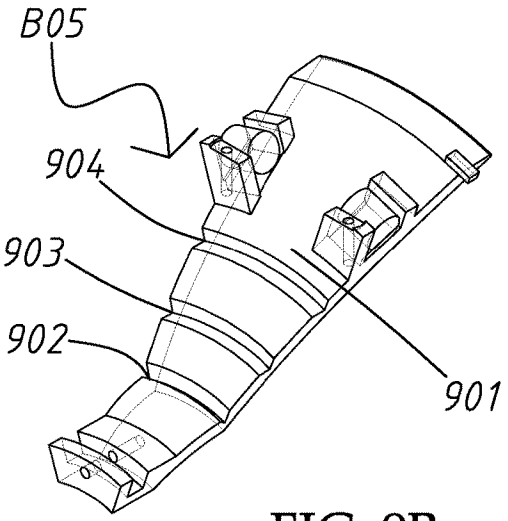
FIGS. 9A to 9B depict a fifth embodiment of a securing ring of the invention.
Figure 9A:
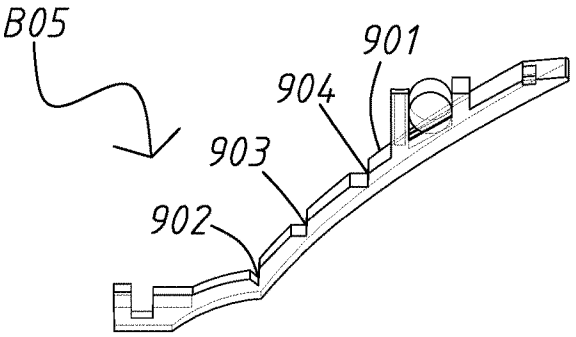

Referring to FIGS. 9A to 9D, a reflective sheet B05 has a structure similar to the structure of the reflective sheet B04 of FIGS. 7A and 7B. The reflective sheet B05 further includes three cut grooves 902, 903 and 904 for cutting a portion of the reflective sheet B05. Referring to FIGS. 9C and 9D, a reflective sheet B06 is formed by removing a portion of the reflective sheet B05 through cutting the cut groove 903.

Figure 10B:
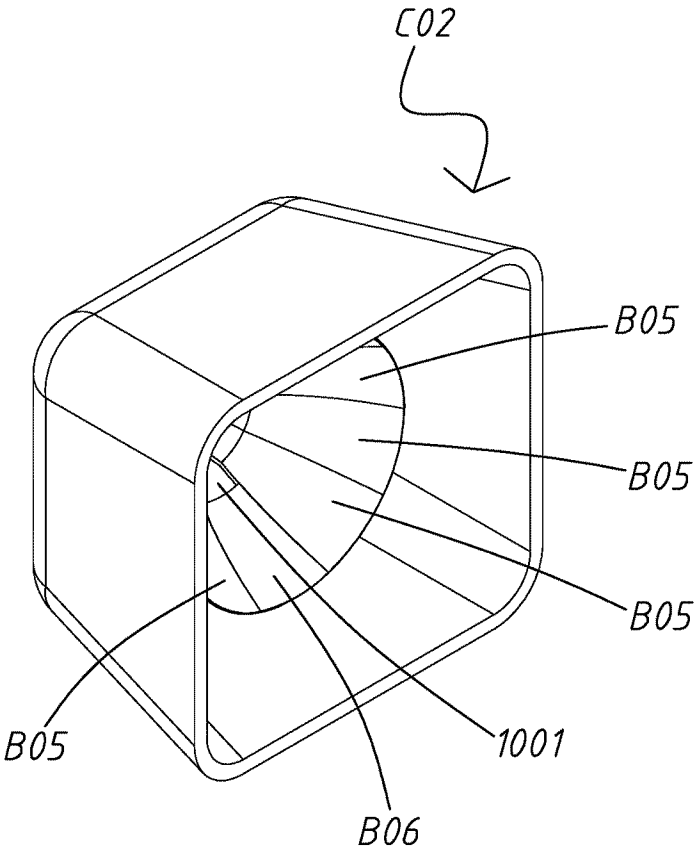
FIGS. 10A to 10B depict a second embodiment of a light emitting module of the invention.
Figure 10A:
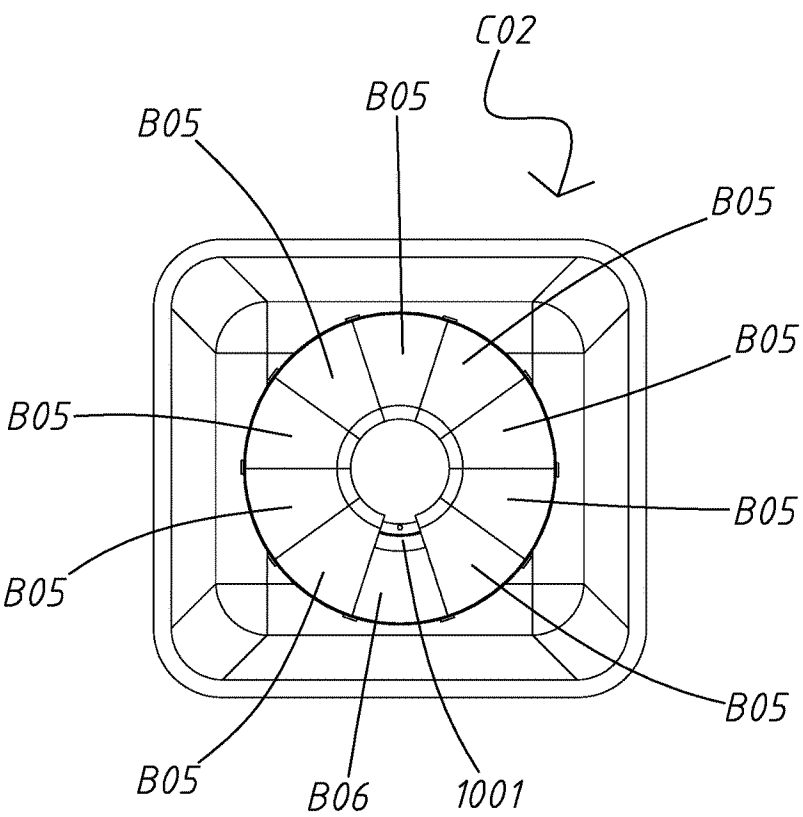

Referring to FIGS. 10A and 10B, a light reflecting module C02 includes a plurality of larger reflective sheets 05 and a smaller reflective sheet B06. The larger reflective sheets B05 and the smaller reflective sheet B06 are assembled to form a notch 1001 for preventing interference with lamps of a vehicle.

The light reflecting module can be mounted to a bulb hole of a vehicle lamp for brightness improvement and upgrade without detaching the water sealing structure of the vehicle lamp so that the water leakage problem caused by detachment of the lamp is avoided.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A light reflecting module, comprising:

a securing ring comprising a tube having an outer surface and an inner surface, at least one non-circular plane extending outwards from the outer surface at one end of the tube and an annular plane extending toward a center of the tube from the inner surface and comprising a top surface and a bottom surface, the annular plane has at least one through hole; and a plurality of reflective sheets, wherein each of the reflective sheets comprises an inner surface which is a curved surface and serves as a reflecting surface, and the width of the reflective sheet is gradually decreased from a bottom surface to a top surface of the reflective sheet.

2. The reflecting module as claimed in claim 1, wherein each of the reflective sheets comprises a hole on the top surface.

3. The reflecting module as claimed in claim 2, wherein the reflective sheet further comprises a groove on the top surface and an L-shaped protrusion protruding from the top surface, the L-shaped protrusion having at least one through hole.

4. The reflecting module as claimed in claim 1, wherein each of the reflective sheets further comprises a positioning element protruding from an end surface of at least one lateral side of the reflective sheet.

5. The reflecting module as claimed in claim 1, wherein each of the reflective sheets further comprises a positioning element disposed on an outer surface of at least one lateral side of the reflective sheet and not exceeding an end surface of a lateral side, and at least one magnet is disposed on the positioning element.

6. The reflecting module as claimed in claim 1, wherein the tube comprises at least one notch.

7. The reflecting module as claimed in claim 1, wherein the tube comprises at least one notch and a spring sheet protruding outwards from the notch.

8. The reflecting module as claimed in claim 1, wherein at least two of the reflective sheets have different curved surfaces.

9. The reflecting module as claimed in claim 1, wherein at least two reflective sheets have different sizes.

10. The reflecting module as claimed in claim 1, wherein at least two of the reflective sheets has different curved surfaces and at least two reflective sheets have different sizes.

* * * * *